US006244947B1

(12) United States Patent
Van Osenbruggen

(10) Patent No.: US 6,244,947 B1
(45) Date of Patent: Jun. 12, 2001

(54) WIRE BRUSH ATTACHMENT FOR ANGLE GRINDER

(75) Inventor: Anthony Alfred Van Osenbruggen, Auckland (NZ)

(73) Assignee: Norton Company, Worcester, MA (US)

( * ) Notice: Subject to any disclaimer, the term of this patent is extended or adjusted under 35 U.S.C. 154(b) by 0 days.

(21) Appl. No.: 09/068,852

(22) PCT Filed: Oct. 15, 1996

(86) PCT No.: PCT/US96/16511

§ 371 Date: May 20, 1998

§ 102(e) Date: May 20, 1998

(87) PCT Pub. No.: WO97/14538

PCT Pub. Date: Apr. 24, 1997

(30) Foreign Application Priority Data

Oct. 19, 1995 (NZ) ..... 280292

(51) Int. Cl.[7] ..... B24B 23/02
(52) U.S. Cl. ..... 451/359; 15/141.2
(58) Field of Search ..... 451/359, 353, 451/508, 358, 549, 342, 59, 463, 464, 465, 466; 125/5; 15/159.1, 141.2

(56) References Cited

U.S. PATENT DOCUMENTS 2,749,681 * 6/1956 Reidenbach ..... 451/527
3,375,617 * 4/1968 Kaufman ..... 451/342
3,959,862 * 6/1976 Salukvadze ..... 15/198
4,099,328 * 7/1978 Schlemmer ..... 451/353
5,201,146 * 4/1993 Fushiya ..... 451/342
5,947,805 * 9/1999 Van Osenbruggen ..... 451/358

FOREIGN PATENT DOCUMENTS

363150147 * 6/1988 (JP) ..... 451/463

* cited by examiner

*Primary Examiner*—Robert A. Rose
(74) *Attorney, Agent, or Firm*—David Bennett

(57) ABSTRACT

Accessories for an angle grinder include a rotary disk tool having a working zone around the periphery of the disk comprising a plurality of wire bristles and a rest means for supporting the grinder on a surface to be shaped. The rest means may be a non-rotating nose beneath the grinder, a rubbing contact mounted on a flat tool or simply the central part of a convex tool Tilting the grinder about the rest means gives effective control of the tool. Steeper tilts cause the cutting surface to bite more deeply into the work. The grinder is stroked toward the user with the cutting zone 2206 trailing. Most disks are perforated. Work to be shaped can be seen through the spinning disk during use. A tool base onto which a variety of cutting surfaces can be affixed is also provided, and a type of wire brush attachment incorporating a rubbing contact is provided.

8 Claims, 5 Drawing Sheets

WIRE BRUSH ATTACHMENT FOR ANGLE GRINDER

TECHNICAL FIELD OF THE INVENTION

This invention relates to the field of disc-shaped rotating abrading tools of the type having manufactured surfaces for abrading and forming materials, and in particular this invention relates to a wire brush accessory which is adapted for use with a hand-held angle grinder.

BACKGROUND

A number of applications in the construction or repair of solid articles involve the selective removal of material from a bulk in order to produce a desired conformation or shape. For example a builder may remove some wood from a beam in order to produce a neat fit—more likely if the house being built is non-rectangular; a foundry removes surplus metal from sprues or joints between mould parts when producing a casting; a wood carver selectively removes wood in order to produce a carving; a panel beater frequently removes surplus plastic filler which was placed within a defect in an automotive panel to build it up, so that the outline conforms with the original outline of the panel; or a boat builder may have to remove kilograms of material, such as lead-filled fibreglass when shaping or repairing a hull.

The act of selective removal, particularly if carried out by abrasive means, involves the expenditure of considerable effort and abrasive materials. The work can be quite slow. There is also a number of problems and health risks associated with the consequent fine dust, having potentially toxic, carcinogenic, or explosive properties. Moreover, dust containing glass fibre is particularly dangerous to the lungs.

One form of tool used for removal of loosely adhered material is a cup-shaped wire brush rotating on a spindle. One such device is described in German OLS 25 02 698.

STATEMENT OF THE INVENTION

In a previous Application published as WO 95/29788 on Nov. 9, 1995, Applicant described an invention in which a first aspect comprised an accessory for a grinder including a rotatable tool having a shape substantially that of a disk, having an axis of rotation and capable of being mounted on an arbor of an angle grinder, characterised in that the rotatable tool is provided with at least one working zone within an active zone extending inwardly from the perimeter of the tool; and rest means extending substantially inwardly from the working zone of the tool, which rest means is displaced from the working zone along the line of the axis of rotation. In some cases the working zone is co-extensive with the active zone.

In a related aspect the previous Aplication comprises an accessory for a grinder characterised in that the rest means is concentric with and supported on the rotatable tool.

In a related aspect the previous Application comprises an accessory for a grinder characterised in that the rest means comprises a portion of a convex working surface of the rotatable tool and the rest means includes at least one rubbing surface located between the active zone and the axis of rotation.

In a related aspect the previous Application comprises an accessory for a grinder characterised in that the rest means comprises a fixed rubbing surface or nose supported on the angle grinder and displaced so as to be supported beyond the rotatable tool. (By "beyond" we mean beyond the end of the arbor, or below the tool as it is normally held).

In a further related aspect the previous Application comprises an accessory for a grinder comprising a rotable tool characterised in that the working zone comprises at least one area within the active zone of the rotatable tool, and the active zone surface extends radially inward over the working surface from the perimeter for up to two thirds and preferably one third of the radius of the rotatable tool.

The present invention provides a further extension of the general concepts embodied in the previous Application described above. In one aspect of this extension the invention provides an accessory for a grinder comprising a rotatable disk-shaped tool, having an axis of rotation and adapted to be mounted on an arbor of an angle grinder, the accessory being provided with a working zone located on the rotatable disk-shaped tool and extending inwardly from the perimeter of the tool; and rest means extending substantially inwardly from the working zone of the tool, which rest means is located radially inward from the working zone and displaced by a fixed distance along the line of the axis of rotation of the tool and away from the grinder, wherein the working zone of the rotatable tool is provided with a plurality of stiff bristles capable of performing a cutting or abrading action when in rotational motion, the bristles projecting from the surface of the working zone and the length of the bristles being such that a portion of the rest means can be contacted with a work surface without contact occurring between the bristles and the work surface.

In a preferred aspect of the invention at least one viewing aperture is provided through the disk of the rotatable tool and at least one viewing aperture may, when the tool is rotating, also serve to cause air movement.

Preferably the grinder has a central recessed mounting aperture provided with gripping means or clutch means capable of disengagement substantially as long as a torque applied between the rotatable spindle and the tool exceeds a predetermined amount and optionally a resilient mounting means capable of reducing vibration.

In use the preferred disk-shaped rotatable abrading tool is mounted on a rotatable spindle, and comprises an active zone on said rotatable abrading tool, which active zone comprises a least one working zone comprising stiff bristles capable of removing material from the work surface, and rest means (a rest zone) dispaced along the axis of rotation by a fixed amount from the working zone, which rest means, in use, permits control of the shaping action of the grinder system by first contacting the rest means with the work surface and then tilting the grinder system to cause or increase engagement of the bristles in the working zone with the work surface.

In a further preferred aspect the invention the rest means comprises a rubbing surface provided with rotational bearing means, which preferably moves on the same axis as the disk-shaped tool, so that in use the rubbing surface may rotate independently of the rotatable tool.

Preferably at least one viewing aperture is provided through the tool and in which at least one viewing aperture may when the tool is rotating also serve as to cause air movement.

The rotatable abrading tool of the invention preferably has a central mounting aperture adapted for attachment to a rotatable spindle.

Preferably the rotatable tool has a central recessed mounting aperture adapted for attachment to a rotatable spindle and is provided with clutch means capable of disengagement while a torque applied between the rotatable spindle and the tool exceeds a predetermined amount.

Preferably the central recessed mounting aperture is also provided with resilient mounting means capable of reducing vibration caused by eccentricity.

Preferably the means for attachment of the tool comprises a shaped depression, shaped to match the profile of an arbor and nut. Preferably the nut includes means to impose a grip on the tool using static friction, and preferably the static friction is overcome at a torque less than that which can damage a means for driving the rotary shaft. Preferably the tool is adapted for use with an ordinary angle grinder. Optionally it may be adapted for use with other rotatable powered machines. Optionally the angle grinder may be fitted with a guard, in order to control swarf.

In use the tool of the invention provides a method for shaping material, comprising the steps of (a) causing a tool according to the above description having viewing apertures therein to be affixed to an angle grinder or the like, (b) applying power to the angle grinder motor, (c) holding the tool against the work while tilted at a low angle to it (so that the rest means contacts the surface but the working surface is not engaged) and raising the tilt to a higher angle so that the working surface contacts the work surface with a controlled pressure, and (d) drawing the tool towards the user meanwhile having the opportunity to view the work through apertures in the rotating tool.

Preferably the tool is adapted for mounting upon the spindle or arbor of an angle grinder tool and for this purpose the tool is provided with an optionally threaded central mounting aperture. Optionally the border of the central aperture is depressed towards the inner surface of the tool. Preferably the tool is made of mild steel although alternatively it may be made from a hardenable metal or alloy or from a plastics material. Optionally the tool may be made by other processes, including pressure die-casting. Preferably a mild steel disk 2 to 6 mm thick provides the basi of the tool. Optionally the disk may be flat and in this case there may be two active zones, one on each major surface, although only one can be used at one time. Preferably the disk is deformed into a conical or curved profile with at least the active zone of the outer surface being a convex surface.

WIRE BRUSH

It is commonly held that wire brush attachments, even a 3 inch, (7.62 cm), diameter cup brush, "kill" angle grinders by imposing high torques. FIG. 2 shows a variety of wire brush disks, in section, suitable for an angle grinder. These are shown as complete disks because the prototype (see FIG. 3) was made in this way. In FIG. 2, the lower version is preferred over the upper version (for most purposes) because the longer bristles have a longer distance in which to flex and should last longer before breaking. Note that in both versions the disk has a central "bare" zone which may be used as a rest zone in accordance with the principles of the invention. (3002 and 3004 represent means for attachment to the arbor of an angle grinder).

FIG. 3 shows a face view 3100 of a prototype wire brush disk for an angle grinder. The outer perimeter of the tool is provided with a plurality of stiff bristles or wires capable of performing a cutting or abrading action when spinning at typical angle grinder speeds. For the prototype these were made by manually fitting bristles though holes drilled in a blade, and gluing them into place after adjusting for length. In this prototype a number of viewing holes 3101 have been made (also useful for enhancing air movement and possibly their edges are also useable for cutting) and a number of bristles of a suitable iron or steel wire have been embedded in the disk towards its periphery, as shown at 2302. A side view of one of the bristled sectors is shown at 3104, with protruding bristles 3103. All of the bristles or wires which may be made of straight or crinkled (crimped) wire project to a height which is less than that of the rubbing surface. Once again, the tool is used with a kind of tilting action, using the central portion of the tool as a rubbing surface and tilting the angle grinder forwards until the bristles are just engaged with the work. In contrast to previous wire brushes for angle grinders, this kind of wire brush does not have any "kick" if used with tilting, as above. We believe that providing the bristles in sectors, with breaks in between, is beneficial to the action of the brush, perhaps by giving the work a little cooling time or perhaps by reducing the torque applied to the angle grinder.

The materials from which the bristles are made are preferably steel or other alloys of iron but other extrudable metals such as copper, brass, bronze, tungsten and the like can be used depending on the toughness requirements imposed by the intended applications. In some situations ceramic fibers may be substituted for the metal fibers providing the bristles. Suitable ceramic bristles include alumina fibers.

DRAWINGS

The following is a description of a preferred form of the invention, given by way of example FIG. 1 shows three general optional profiles for the basic tool member useful in the present invention (without the bristles).

PREFERRED EMBODIMENT THEORY PRINCIPLES

The invention is used primarily as a component of a hand-held grinder system. As practically all of these are for the type of machine known as an angle grinder we shall predominantly refer to angle grinders. In addition the invention will be more particularly described with reference to the above Drawings.

Figure 1:
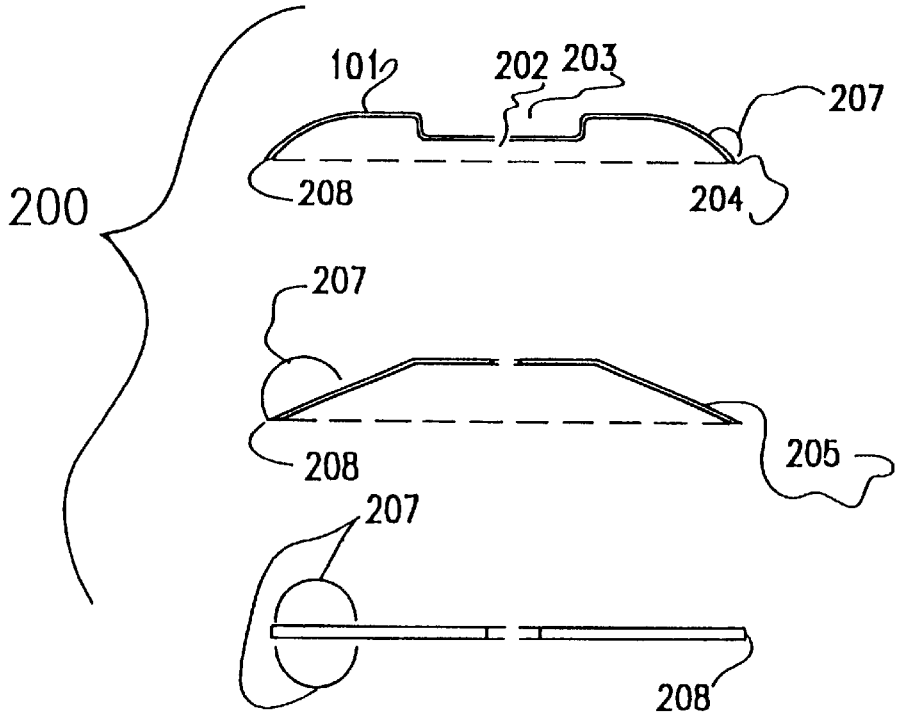
Figure 2:
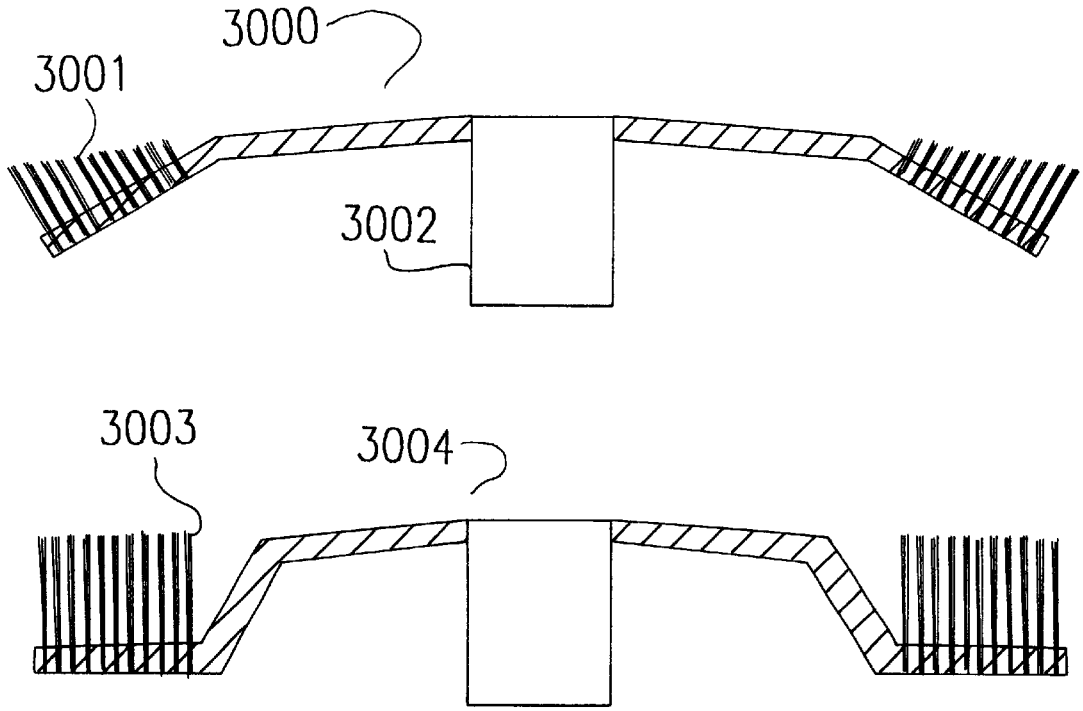
FIG. 2 shows a variety of wire brush disks for an angle grinder.

The angle grinder is provided with a rest point, (or rest means), comprising means to lean or rest the tool on the work surface, while in use, and from that rest point, gradually slope or incline the machine until the bristles in the working zone of the tool start abrading the work surface. From this time the grinder may be slid or "stroked" preferably towards the operator. The apertures or viewing holes in the tool permit the surface being treated to be inspected prior to abrading. The rest means can optionally be provided on the body of the angle grinder; most conveniently as part of a guard beneath a portion of the wheel (FIGS. 4 and 5) or alternatively we can provide that the rest means is located on the spinning disk, where it may form:

(a) A more central part of the disk—here a domed or convex disk is preferred (FIG. 1/101), (b) An attached protrusion such as a domed washer, spinning with the disk (here the disk itself may be flat though still providing an active zone at one side of its perimeter) or (c) An attached though separately rotatable protrusion, such as a domed washer mounted by means of a bearing onto the disk or grinder spindle. This is commonly termed a "dead" guide.

Intimately associated with this method-based concept is the provision of abrading tools having an active, or working, zone comprising the entire outer perimeter extending inwards by about one third of the radius, or an active zone comprising isolated abrading sites within the entire active zone, and a rest zone located radially inward of the working zone.

In more detail, the preferred tool comprises an optionally perforated metal disk capable of attachment to the angle grinder shaft. Preferred disks are convex, like the saucer for a cup, and have an active working zone with abrading bristles located on or about the convex perimeter.

Because the invention comprises a disk rotated at a high speed it acquires a considerable angular momentum which helps provide a steady rate of abrasion. In one preferred form, the tool is adapted to be used with a conventional angle grinder of the widely used type having a typical no-load rotation speed of 11,000 rpm, driven usually by a universal (AC/DC) brush motor. Conventional angle grinders provide a drive shaft onto which various discs (normally of abrasive material) may be mounted and spun at a high speed. A typical angle grinder is the single-speed 115 mm grinder sold as the "AEG WSL115" (TM) (600 watts). This size of motor provides an acceptable power for the prototype disks. A variable-speed angle grinder may be an advantage.

In use, the work-material and the working surface of the disk are brought together so that the work-material approaches the working zone from the centre of the disk and the trailing edge of the working zone is the disk edge. The work at or close to the site of the abrading is partially visible through holes cut through the disk.

When using an angle grinder with a tool according to this invention, the preferred movement is to drag the tool towards the user, or stroke it over the work material, while the working zone engages the material. The preferred apertures allow the user to see, through the disk, the site where the tool is about to cut or abrade. There is relatively little or no "kick" from the tool (not often the case with ordinary angle grinder tools or saw-like modifications), and it is easy to hold and control the machine during operation in order to carry out relatively fine movements.

Figure 3:
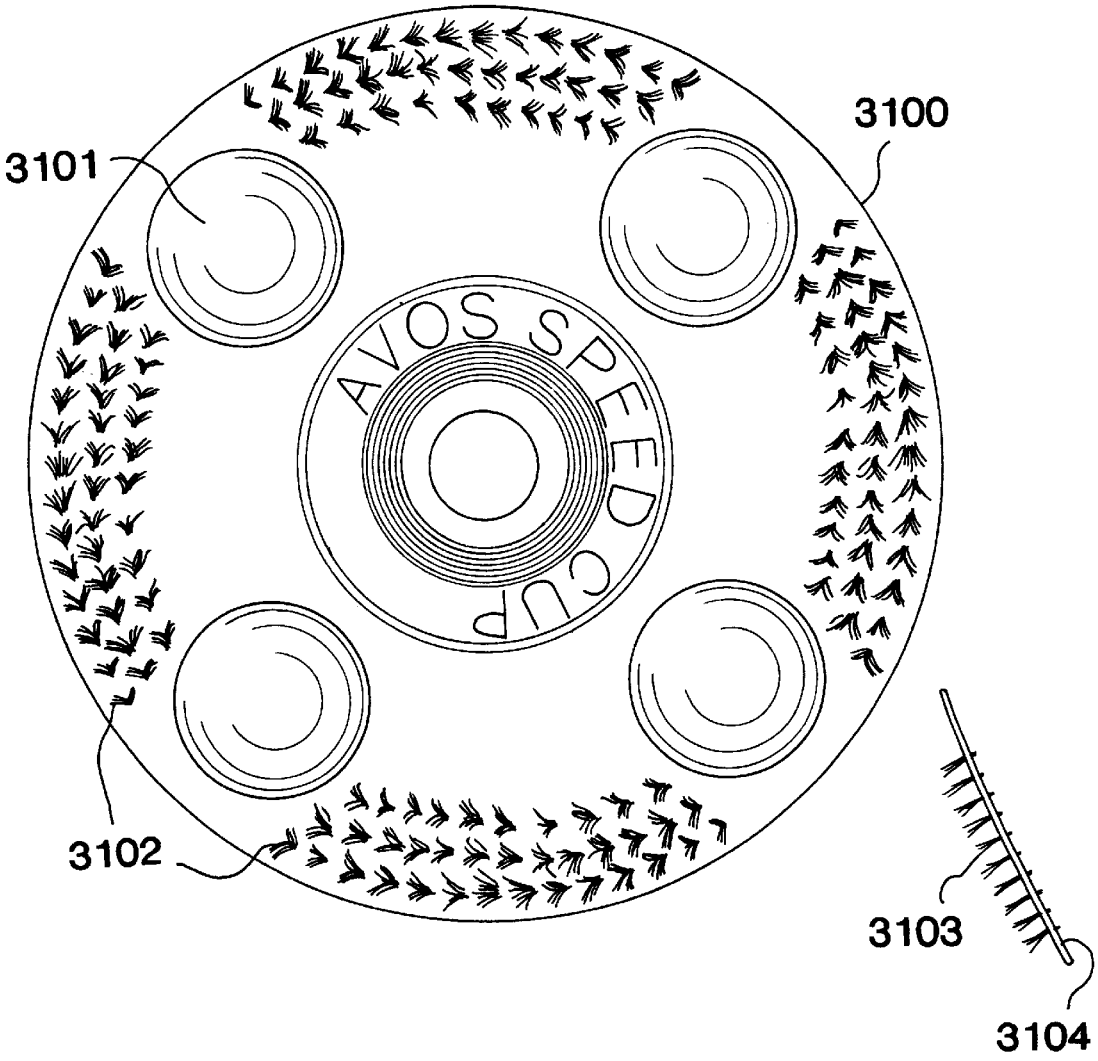
FIG. 3 shows a face view of a wire brush disk for an angle grinder.
Figure 4:
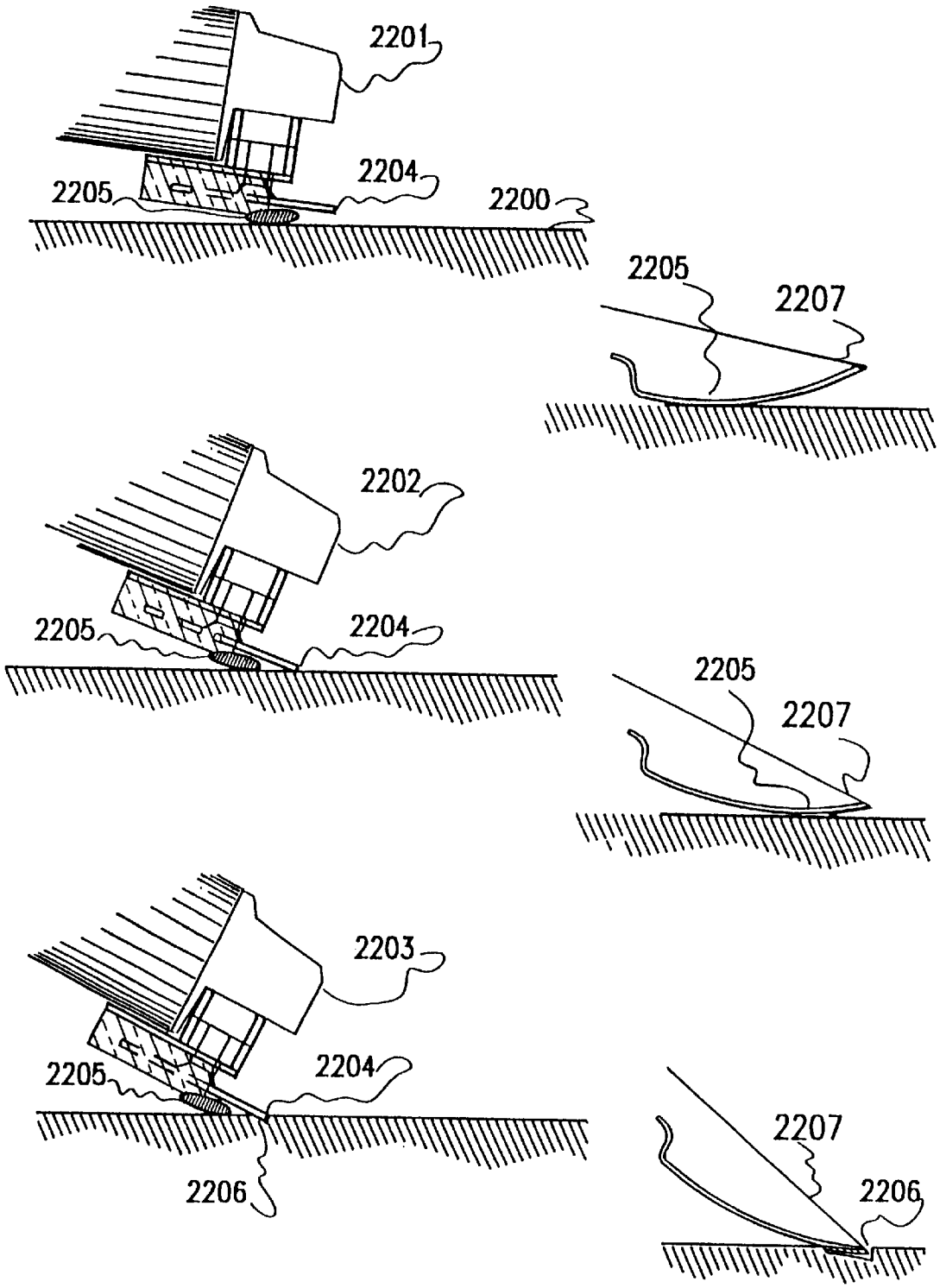
FIG. 4 shows the method whereby an angle grinder incorporating a tool according to the invention, (minus the bristles), is used. The tool is inclined about the rest point in order to engage, or further engage, the active contact zone with some work material.

The angle made by the handle of the angle grinder to the work is typically about 30 degrees, (varied by the user from about 15 degrees to about 40 degrees) using the example cutter, but this depends on the shape to be formed. The angle allows the effective tooth protrusion amount to be varied. FIG. 4 illustrates this method, (minus the bristles for the sake of clarity), in which the rest means is a nose (left side series) or a rubbing surface. At the left are three variations (2201, 2202 and 2203) of tilt (respective to a work surface 2200) of an angle grinder with a nose 2205 and a flat disk 2204; wherein the grinder system is being tilted on its nose 2205 so that the rotating disk 2204 approaches the work. In the centre left drawing the disk is just contacting the work. In the lowest left drawing it has eaten into the work at 2206. At the right of FIG. 4 are shown three angles of tilt of a convex tool with an annular blade attachment 2207, (minus the bristles), where the rubbing surface 2205 (which in this example is part of the rest zone ans also a part of the actual disk) moves towards the periphery until in the lowest drawing the bristles on the disk, (not shown), are abrading the work surface at 2206. Under full working load the disk has a rotation speed of 8,000 rpm, which approximates, for a disc having four distinct working areas in the active zone, (as shown for example in FIG. 3), 32,000 abrading actions per minute. The operator uses the sound of the loaded motor as a guide in adjusting the speed of abrading.

DISK ITSELF

We prefer to provide a dished disk so that we can place the bristles on the outside or convex side of the disk near its rim, and so allow the user to vary the abrading pressure by tilting the disk. Disks can be curved in profile, or include a conic section, or in some cases may be flat. At the disk centre we prefer to provide a profile that mates with an arbor though optionally each abrading disk may include a thread for direct mounting, perhaps with a spacing washer. The conic or curved profile can be a separate part of a disk.

We have made prototype tools from mild steel sheet, from 3 to 6 mm in thickness, and from stainless steel, though other materials can be used. The overall diameter is set by the abrading disk guard and generally ranges from about 4 to 4.5 inches (100–112 mm) for a nominally 4.5 inch angle grinder. The first prototype was made by spinning a heated disk of mild steel on a lathe. Other methods of forming a metal disc include stamping and shaping from sheet stock, or using laser-cutting techniques (particular for hole cutting), then pressing in a die. A abrading disk of a plastics material may be made by the usual techniques such as injection moulding and optionally these techniques include provision of a fibrous base or core about which a matrix is formed.

Flat-bladed disks with annular attachments can also be produced according to this invention. In order to provide a rest zone or rubbing surface for use with such a flat disk, a kind of dome nut can be used as part of the attachment of the disk to the grinder drive shaft. The head of this dome nut is held in rubbing or sliding contact with the work, and the cutter is tilted so that the bristles dig in at a suitable rate. The dome nut may be shaped more like a mushroom, but then the increased radial velocity of the surface in contact leads to increased friction, wear, and reaction forces.

Optionally, a separately mounted domed spacer may be used. This can be, at least in part, rotationally mounted—for example, on a ball-bearing—so that it may come to rest rather than rub on the surface of the work, and provide a rest zone as a non-rubbing surface without friction. In the case of some plastics (for example), the friction generated by sliding at the rubbing surface (especially at the rates of revolution typical of angle grinders) may cause local burning, melting, difficulty of control, and damage to the surface. This improvement overcomes that problem.

Figure 5:
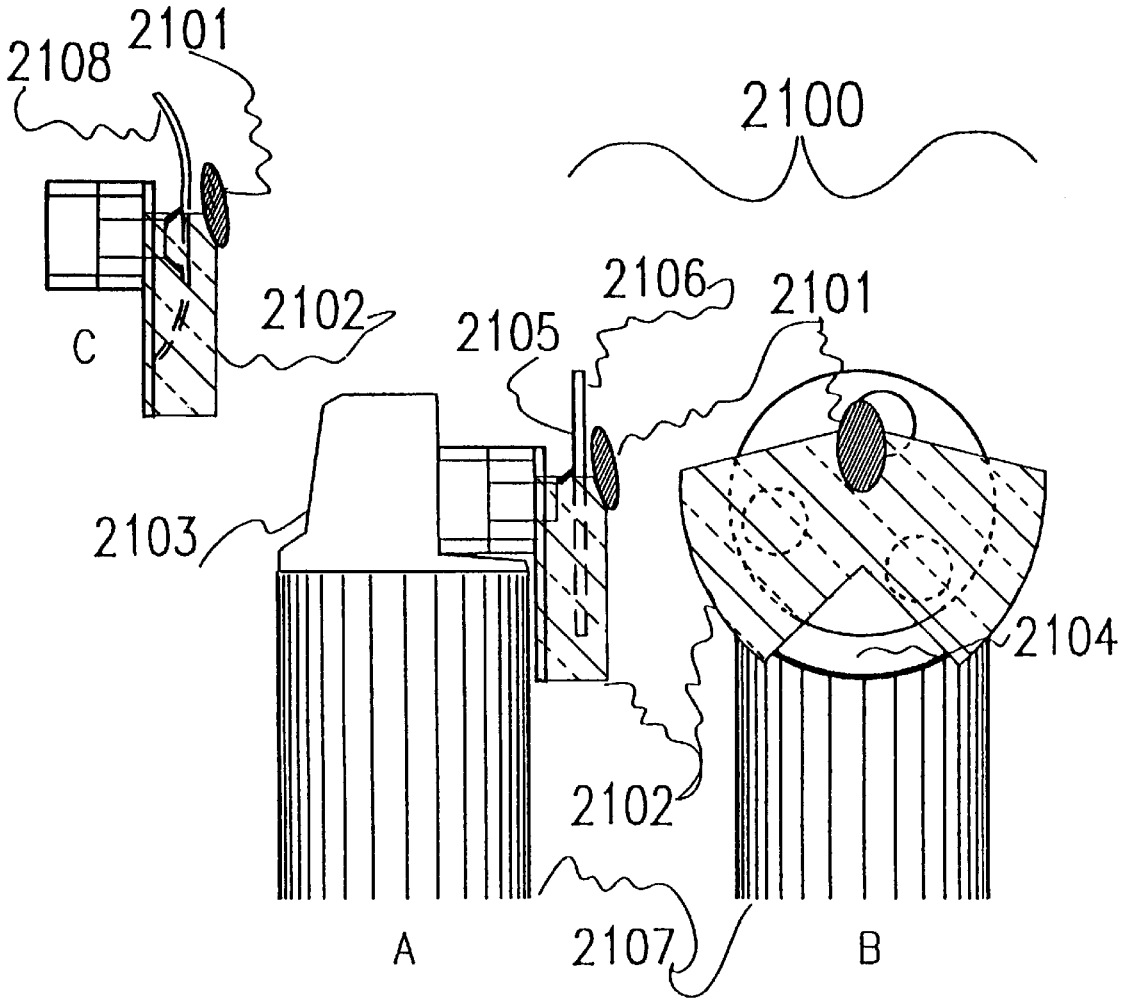
FIG. 5 shows a type of guard for a grinder system, including a central mound or protrusion capable of being used as a rest point, hence better control of the tool is possible. This type of system is particularly useful where the tool is flat.

A further type of rest means is provided on the actual angle grinder itself—not on the surface of its abrading disk. FIG. 5 illustrates a hard "nose" 2101 of for example hardened steel, chromium alloy, or for some applications a low-friction nose of PTFE plastic (polytetrafluorethane or "Teflon (™)") which is attached to the centre of a partial guard 2102 attached beneath the abrading disk of an angle grinder 2103. The beneath view B depicts an aperture 2104 which is intended for the ejection of waste material—swarf and the like. The side view A shows a flat disk type of abrading disk 2105 which is provided with bristles, (not shown), presented to the edge 2106. It will be evident that if the nose 2101 is rested on work material, and the body of the angle grinder 2107 is tilted so that the "active" edge 2106 of the abrading disk comes into contact with the work, an operator has a far better degree of control over rate and depth of abrading than if lie or she has no "nose" or rest means and has to set the active edge in the correct position solely by hand positioning.

The guard 2102 may be provided with a hinge and catch mechanism (not shown) so that it can flip open to allow the abrading disk to be cleaned or changed. Part C of this drawing shows an abrading disk 2108 having a dished profile and the adjacent nose 2101 and guard 2102. This presents a more nearly parallel alignment of tooth edges to a sheet of work material and is for example more suited to hand planing. This modification to provide a grinder system having rest means is not incompatible with the extra guard 1705 offered in FIG. 17 for the upper surface of the disk.

DISK HOLES

Perforations in the disk are provided in part so that the user can see the material to be abraded through the spinning disk as the tool working zone is drawn towards the user. For convenience the perforations are circular or at least have no sharp or narrow corners because of the risk of propagation of cracks from stressed areas. Holes 24 mm in diameter have been suitable. The holes are preferably equidistant from the centre but this arrangement is not essential. Clearly, hole positions should be selected so as to retain the balance of the disk, and disks may be balanced dynamically by removing material from hole edges. The perforations may also aid in stirring the air so that any swarf is carried by the moving air and is ejected further or more effectively. For moving air the holes may be racked (drilled obliquely) or pitched. They may also be used as clamping points for a jig for alignment of the abrading disk in automated sharpening operations.

Holes are a preferred option for the disks of the invention; providing visibility of the work about to be abraded, and aiding (especially if raked) in stirring and moving the air. The preferred embodiment has three equally spaced holes. Other combinations which place various holes at different distances from the centre may be used; although it is always preferable to maintain static and dynamic balance in rapidly rotating disks.

MOUNTING MEANS

We have provided a central threaded aperture in our prototypes. Generally a spacer or thrust washer of approximately 10 mm thickness is used about the arbor or spindle of the angle grinder, beneath the concave face of the disk, so that its spinning edges clear the guard of the angle grinder; although a suitably pressed abrading disk having a depressed mounting hole may not require the use of a spacer. Conveniently the threaded disk prototypes do not bind onto the angle grinder during use.

MOUNTING SYSTEM

Figure 6:
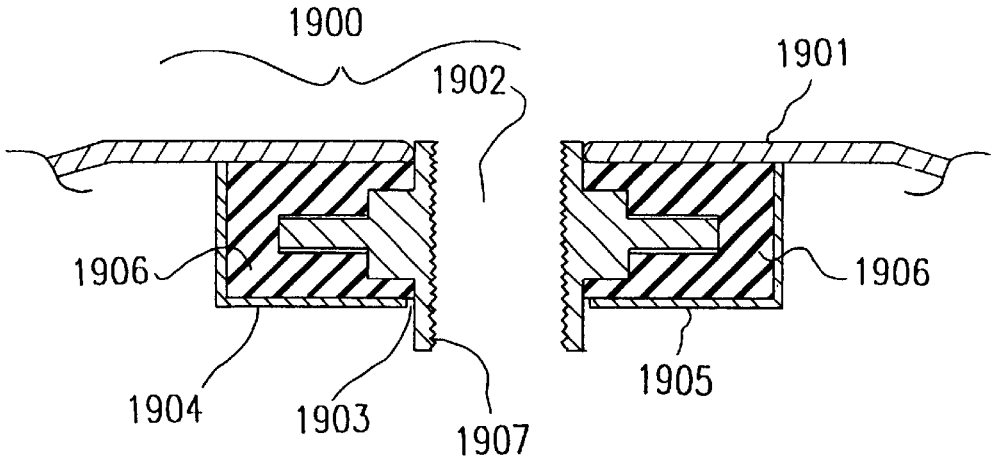
FIG. 6 shows a type of resilient central mount for a tool according to the invention.

A further improvement is the use of a flexible or resilient mount, inserted between the arbor of the angle grinder and the material of the disk - any disk described or illustrated herein. FIG. 6 shows at 1900 a resilient central mount for a wheel 1901, having among other purposes the objective of minimising the effect of wheel imbalance on tool vibration. In FIG. 6, the resilient material (which is illustrated as 1906) is contained within a housing 1904 attached to the wheel, while a central threaded collar 1907 surrounding an aperture 1902 is attached to a fin 1905 running deeply into the resilient material, which is generally a type of rubber. There is a small gap at the base to allow wobble between the housing and the thread at 1903. Optionally the small gap may be at the outside, and the inner gap may be an interference fit. Optionally there may be a further layer of metal, between (and attached to) the resilient material and the fin 1905, to which it is not attached apart from a frictional grip, thereby providing a clutch so that if the torque exceeds a threshold, the fin 1905 may slip inside the further layer of metal. The base of the threaded collar (by 1907) serves as a nut to lock the wheel onto the arbor of the grinder.

Figure 7:
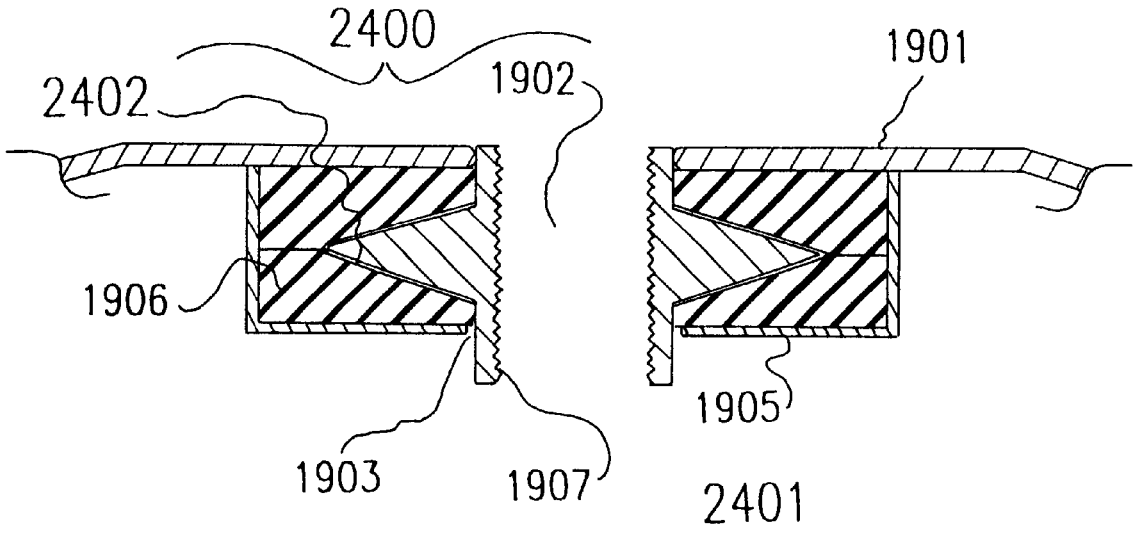
FIG. 7 shows an alternative clutch and central resilient mount for a disk.

We have also designed an alternative mounting system for an angle grinder. This is illustrated in FIG. 7 which shows at 2400 an alternative clutch and central resilient mount to that of FIG. 6 for use with a tool base or disk. The clutch is designed to allow slippage when the torque applied to the tool is greater than a preset amount. It may include a "chatterbox" of some type to give an audible indication of slippage, and one way of providing this is to place several ball bearings 2402 between the disk and the resilient mount so that the balls click into or out recesses if the clutch slips. In this example the portion of the resilient mount threaded onto the arbor of the angle grinder has a cone-shaped projection (as seen in section 2401) into the resilient material.

ADVANTAGES

Advantages of preferred forms of this invention include

1. Material is removed quickly.
2. There is little reaction or kickback against the tool edge, reducing stresses on operators, and minimising the risk of exhaustion and errors which may be expensive and/or dangerous;
3. Control of the results is excellent, achieved by tilting (to vary the bite) and moving the tool over the work surface, while experiencing little kickback.
4. The user can see through perforations in the spinning disk to accurately produce a desired conformation, or shape;
5. The material of the disk need not be high-quality steel as is the case for circular saw blades, for example.
6. The work applied to the tool (ie. the power consumption of the grinder) is usually low enough to enable a rechargeable battery-operated grinder to be used.

Finally, it will be appreciated that various alterations and modifications may be made to the shape of the disk, and the materials used in constructions, without departing from the scope of this invention as set forth.

What is claimed is:

1. An accessory for a grinder comprising a rotatable disk-shaped tool having an axis of rotation and adapted to be mounted on an arbor of an angle grinder and being provided with a working zone extending inwardly from the perimeter of the tool; rest means located radially inwardly of the working zone of the tool and displaced by a fixed distance from the working zone along the line of the axis of rotation of the tool and away from the grinder, characterized in that the working zone of the rotatable tool is provided with a plurality of bristles capable of performing a cutting or abrading action when in rotational motion, the bristles projecting from the surface of the working zone and the length of the bristles being such that a portion of the rest means can be contacted with a work surface while the tool is rotating with no cutting or abrading contact occurring between the bristles and the work surface and the disk-shaped tool is provided with at least one viewing aperture through the disk.

2. An accessory according to claim 1 in which the bristles are formed from metallic wire.

3. An accessory according to claim 1 in which the bristles are located in a working zone extending from the outer perimeter of the disk-shaped tool to a point that is up to two thirds of the distance from the perimeter to the axis of rotation.

4. An accessory according to claim 1 in which the bristles are located in a working zone extending from the outer perimeter of the tool to a point that is up to one third of the distance from the perimeter to the axis of rotation.

5. An accessory according to claim 1 in which the bristles are located in at least two groups equally spaced around the working zone.

6. An accessory according to claim 1 in which the tool has a convex surface with the working zone provided by an outer peripheral portion of the convex surface of the disk and in which the rest means is provided by a portion of the convex surface of the disc located within the working zone.

7. A grinder comprising an accessory according to claim 1 in which the rest means comprises an attached protrusion spinning with the accessory.

8. A rotatable abrading tool according to claim 1 in which the rest means comprises a separate protrusion mounted on the tool.

* * * * *